US006582045B2

(12) United States Patent
Hirayama

(10) Patent No.: US 6,582,045 B2
(45) Date of Patent: Jun. 24, 2003

(54) PRINTING APPARATUS AND PRINTING CONTROL METHOD

(75) Inventor: Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/132,376

(22) Filed: Apr. 26, 2002

(65) Prior Publication Data

US 2002/0158930 A1 Oct. 31, 2002

(30) Foreign Application Priority Data

Apr. 27, 2001 (JP) ..... 2001-132931

(51) Int. Cl.[7] ..... B41J 29/38
(52) U.S. Cl. ..... 347/14; 347/14; 347/197
(58) Field of Search ..... 347/14, 191

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,319,389 A | | 6/1994 | Ikeda et al. | 347/19 |
| 5,521,620 A | | 5/1996 | Becerra et al. | 347/14 |
| 5,943,069 A | | 8/1999 | Kamiyama et al. | 347/14 |
| 6,068,360 A | * | 5/2000 | Hiwada | 347/14 |
| 6,382,755 B1 | * | 5/2002 | Imanaka et al. | 347/12 |
| 6,382,756 B1 | | 5/2002 | Komuro | 347/14 |

FOREIGN PATENT DOCUMENTS

| | | | |
|---|---|---|---|
| EP | 0 913 255 | 5/1999 | B41J/2/05 |
| JP | 10-95116 | 4/1998 | B41J/2/05 |

* cited by examiner

*Primary Examiner*—Thinh Nguyen
*Assistant Examiner*—Alfred E Dudding
(74) *Attorney, Agent, or Firm*—Fitzpatrick, Cella, Harper & Scinto

(57) ABSTRACT

Disclosed is a printing apparatus for performing printing on a printing medium, based upon information transmitted from an external device, by causing a carriage, on which a printhead is mounted, to scan across the printing medium. The printhead includes any one of voltage detecting means for detecting at least one voltage among voltages at a node between a first power-supply wire and a monitor resistor element, a node between the monitor resistor element and a driving element, and a node between the driving element and a second power-supply wire; and any one of current application means for applying current to at least one of the nodes. At least one resistance is obtained, based upon applied current or detected voltage, from among resistance of the first and second power-supply wires, resistance of the monitor resistor element and resistance of the driving element, and the printhead is controlled based upon the resistance obtained.

12 Claims, 10 Drawing Sheets

PRINTING APPARATUS AND PRINTING CONTROL METHOD

FIELD OF THE INVENTION

This invention relates to a printing apparatus and to a method of controlling printing in the printing apparatus. More particularly, the invention relates to an ink-jet printing apparatus for ejecting ink by utilizing thermal energy, and to a method of controlling printing by the printing apparatus.

BACKGROUND OF THE INVENTION

In a printer of the type which uses an ink-jet printhead to print images by ejecting ink, non-uniformity in the size of the ejected ink droplets leads to a decline in the quality of the printed image, which can also result from an attendant unevenness in density. Therefore, in order to perform high-quality printing, it is desirable that the size of the ink droplets be held constant at all times.

With a printhead of the type which causes ink to foam by heating the ink within the printhead so that the ink is ejected by the pressure produced, droplets of a constant size can be ejected by forming bubbles of a constant size.

If the energy introduced to a heater within the printhead is too low, the jetting of the ink may become unstable. If too much energy is introduced, the heater elements may deteriorate and burn out. In an arrangement where the ink is heated by a heater, therefore, it is vital that the amount of heat produced by the heater be held constant.

A heater board on which heater elements are formed is fabricated through a semiconductor manufacturing process. The circuit that drives these heater elements also is formed on the heater board through the same manufacturing process. The resistance value of a heater element fabricated by semiconductor film-forming techniques varies from one heater board to another depending upon the manufacturing lot. As a consequence, even if the voltage applied to the heater is constant, the heater driving electrical energy introduced to the heater will differ depending upon the resistance value of the heater when the resistance value exhibits the above-mentioned variation. In order for the energy introduced to the heater to be held constant irrespective of this disparity in the resistance value of the heater, it is required that the energy of the heat evolved be adjusted based upon the length of time over which current is passed through the heater.

The specification of Japanese Patent Application Laid-Open No. 10-95116 proposes means which corrects for this variation in heater resistance from one heater board to another. Specifically, a heater board on which a heater element is formed is provided with an element for sensing a variation in the resistance value of the heater, the information acquired from the sensing element is extracted, and a correction is applied by adjusting the driving pulse width, which is a condition of the driving signal applied to the printhead from the printer proper. As a result, the amount of heat evolved by the heater is rendered constant.

To deal with the higher density of driving elements, recent printhead heater boards are fabricated by a CMOS semiconductor manufacturing process in which the process steps are reduced to enable a reduction in cost. In accordance with this process, heaters and MOS transistors are serially connected and the MOS transistors are controlled so as to turn on the desired heaters. In this case, ON resistance, which is the value of resistance when a MOS transistor is turned on, also usually exhibits a variation on the order of several tens of percent.

In a case where a heater board is formed on a semiconductor wafer, the number of chips that can be manufactured from a single wafer can be increased by reducing the area of the heater board, thereby making it possible to raise the yield of manufacture. In terms of lowering cost, therefore, a MOS transistor of small area is preferred.

The ON resistance value of the MOS transistor should be sufficiently small in comparison with the resistance value of the heater in order to suppress the influence of resistance-value variation on energy applied to the heater. Lowering the ON resistance involves enlarging the gate width of the transistor, however, as a result of which the transistor occupies a greater area on the heater board. A transistor having such an area that will reduce the ON resistance value sufficiently is difficult to form on a heater board if it is desired to achieve the reduction in cost mentioned above. If the ON resistance value of a MOS transistor serially connected to a heater exhibits variation, the voltage drop across the MOS transistor will fluctuate and so will the voltage impressed upon the heater. If the resistance value of the heater exhibits variation, then the energy applied to the heater will fluctuate in similar fashion.

The specification of Japanese Patent Application Laid-Open No. 10-95116 proposes a method of sensing a variation in the ON resistance of a MOS transistor. A method of measuring the resistance value of a heater and the ON resistance of a MOS transistor according to this proposal is performed as set forth below.

As shown in the equivalent circuit of FIG. 3, a driving element fabricated with the same design and through the same process as those of a driving element provided on a heater board is disposed as an ON-resistance measurement element on individual heater boards constituting printheads. The ON-resistance measurement element is driven by a signal from a device external to the head, the ON resistance value is calculated from the relationship between applied current and measured voltage, and pulse width, which is a driving condition, is varied using a table that is set up beforehand on the side of the device. If this arrangement is adopted, the energy applied to an electrothermal transducer can be rendered constant from one head to another. If the energy is constant between heads, a uniform printing performance is obtained between heads and printing yield rises. This also eliminates rapid burn-out ascribable to deterioration of the heater element due to application of excessive energy. The end result is enhanced printhead reliability.

The ON resistance value generally is low (approximately 10Ω). Accordingly, there are cases where the measurement precision (S/N ratio) of the ON-resistance measurement element, which serves as the driving element whose design is the same as that of the driving element of the electrothermal transducer, is unsatisfactory. In such case, however, it is possible to use an ON-resistance measurement element whose design is altered so as to improve measurement precision. It is required in such case that the relative value of amount of variation be kept unchanged. In the case of an NMOS transistor, this can be dealt with by changing the gate width.

As set forth in the specification of Japanese Patent Application Laid-Open No. 10-95116, it is also possible to adopt an arrangement in which an element for sensing a variation in sheet resistance value is fabricated on a heater board on which an electrothermal transducer is formed, with this element being provided along with the above-mentioned ON-resistance measurement element, as shown in FIG. 4. Here two lines usually are required, namely a signal line from the ON-resistance measurement element and a signal line from the element that senses the variation in sheet resistance value. However, it is preferable to adopt an arrangement in which the signal line from the ON-resistance measurement element and the signal line from the sensing element are connected within the heater board so that a single signal line will suffice. Specifically, an arrangement should be adopted in which the signal line from the ON-resistance measurement element and the signal line from the sensing element are connected in parallel, as illustrated in FIG. 4. By applying a certain signal, e.g., a clock selection signal, to the ON-resistance measurement element, the ON-resistance measurement element, namely the driving element, is turned on and off, whereby the ON resistance of the driving element and the sheet resistance of the electrothermal transducer can be extracted at a single external output terminal.

When the driving element is ON, information (resistance values) from both the ON-resistance measurement element and the element that senses the variation in sheet resistance value can be sensed. When the driving element is OFF, only the information from the element that senses the variation in sheet resistance value can be sensed. If this arrangement is adopted, one signal line lead to the outside will suffice. As a result, without any increase in the cost of the printer per se and printhead, a variation in the printing performance of the printhead can be reduced, yield can be raised and reliably can be enhanced by eliminating early premature burn-out of the electrothermal transducer.

The result of measurement from the ON-resistance measurement element and the result of measuring variation in the sheet resistance value of the heating resistor are thus output to the external terminal via an external output terminal, thereby making it possible to change the driving conditions of the driving element or heating element.

In recent years, however, printheads have come to require the use of a heater board having a long row of nozzles that furnish a greater printing width per scan in order to support high-speed printing. Further, reducing the area of the heater board is important in order to lower cost. The result is a heater board in which the width at right angles to the heater row is comparatively small. The wiring resistance of wiring that supplies power to the heater within the heater board and to the transistor that drives the heater increases owing to the elongated heater board. This is due to the greater distance from a contact pad to the heater or the transistor.

Furthermore, the number of heaters driven simultaneously is greater in order to achieve high-speed printing. In order to avoid a fluctuation in the voltage drop of the wiring, the number of wires within the heater board is increased. If there is no change in the area needed for this wiring, the wiring area per wire will diminish and, hence, wiring resistance per wire will increase.

Since wiring is made of aluminum or the like using semiconductor film-forming techniques, manufacturing variation on the order of several tens of percent usually appears as the resistance value. As a consequence, when wiring resistance rises and becomes so large relative to the heater resistance value as to no longer be negligible, the variation in the resistance value of the wiring connected serially to the heater has a great effect upon the energy introduced to the heater.

Owing to such an increase which cannot be disregarded in the effect of the variation in wiring resistance, it is difficult to calculate the energy introduced to the heater from the resistance value of the heater and measurements of the ON resistance value of the MOS transistor, which drives this heater, by the prior-art circuit set forth in the specification of Japanese Patent Application Laid-Open No. 10-95116.

As a consequence, energy introduced to the heater may be too small or too large owing to a variation in wiring resistance value. This can cause ink to be ejected unstably, resulting in blurred printing. Further, if an excessive amount of energy is applied to a heater, deterioration of the heater hastens and the heater may burn out.

SUMMARY OF THE INVENTION

Accordingly, an object of the present invention is to provide a printing apparatus and method of controlling printing that solve the aforementioned problems of the prior art.

According to the present invention, the foregoing object is attained by providing a printing apparatus for performing printing on a printing medium, based upon information transmitted from an external device, by causing a carriage, on which a printhead is mounted, to scan across the printing medium. The printhead comprises: a printing apparatus for performing printing by using the printhead on a printing medium, based upon information transmitted from an external device, the printhead including selection means for selecting one driving element to be driven; a first wiring structure in which the driving element and a monitor resistor element are serially connected; a second wiring structure in which the monitor resistor element and a first power-supply wire are serially connected; a third wiring structure in which the driving element and a second power-supply wire are serially connected; and detecting means for detecting at least one voltage among voltages at a node between the first power-supply wire and the monitor resistor element, a node between the monitor resistor and the driving element, and a node between the driving element and the second power-supply wire. At least one resistance is obtained, based upon the detected voltage, from among resistance of the first and second power-supply wires, resistance of the monitor resistor element and resistance of the driving element, and the printhead is controlled based upon the resistance obtained.

Preferably, the detecting means includes switching means for switching among voltages to be detected, with the switching means switching among detection of voltages at the node between the first power-supply wire and the monitor resistor element, or the node between the monitor resistor element and the driving element, or the node between the driving element and the second power-supply wire, in accordance with a detection control signal.

Preferably, the printhead is an ink-jet printhead for printing by ejecting ink.

Preferably, the printhead is an ink-jet printhead for printing by utilizing thermal energy, the printhead having a thermal energy transducer, which is for generating thermal energy applied to the ink, as the printing element of the printhead.

Further, according to the present invention, the foregoing object is attained by providing a method of controlling printing of a printing apparatus for performing printing on a printing medium, based upon information transmitted from an external device, by causing a carriage, on which a printhead is mounted, to scan across the printing medium. The method includes a selection step of selecting one driving element to be driven; a detection step of detecting, in a first wiring structure in which the driving element and a monitor resistor element are serially connected, a second wiring structure in which the monitor resistor element and a first power-supply wire are serially connected, and a third wiring structure in which the driving element and a second power-supply wire are serially connected, at least one voltage among voltages at a node between the first power-supply wire and the monitor resistor element, a node between the monitor resistor element and the driving element, and a node between the driving element and the second power-supply wire; and a control step of obtaining at least one resistance, based upon the detected voltage, from among resistance of the first and second power-supply wires, resistance of the monitor resistor element and resistance of the driving element. The printhead is controlled based upon the resistance obtained.

Preferably, the detecting step includes a switching step of switching among voltages to be detected, the switching step switching among detection of voltages at the node between the first power-supply wire and the monitor resistor element, or the node between the monitor resistor element and the driving element, or the node between the driving element and the second power-supply wire, in accordance with a detection control signal.

Further, according to the present invention, the foregoing object is attained by providing a printing apparatus for performing printing on a printing medium, based upon information transmitted from an external device, by causing a carriage, on which a printhead is mounted, to scan across the printing medium. The printhead includes any one of voltage detecting means for detecting at least one voltage among voltages at a node between a first power-supply wire and a monitor resistor element, a node between the monitor resistor element and a driving element, and a node between the driving element and a second power-supply wire; and any one of current application means for applying current to at least one of the nodes; wherein at least one resistance is obtained, based upon applied current or detected voltage, from among resistance of the first and second power-supply wires, resistance of the monitor resistor element and resistance of the driving element, and the printhead is controlled based upon the resistance obtained.

Preferably, the pressure detecting means includes switching means for switching among voltages to be detected, with the switching means switching among detection of voltages at the node between the first power-supply wire and the monitor resistor element, or the node between the monitor resistor element and the driving element, or the node between the driving element and the second power-supply wire, in accordance with a detection control signal.

Preferably, the current application means includes current switching means for switching over application of current, with the current switching means switching between detection of voltages at and application of current to the node between the first power-supply wire and the monitor resistor element, or the node between the monitor resistor element and the driving element, or the node between the driving element and the second power-supply wire, in accordance with a control signal.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

Preferred embodiments of the present invention will now be described in detail with reference to the accompanying drawings.

In the embodiments set forth below, a printer will be described as an example of a printing apparatus using the ink-jet printing method.

In this specification, the term "print" signifies not only the formation of significant information such as characters and graphics but also the formation of images, figures and patterns, etc., on a printing medium in the broad sense, regardless of whether the information formed is significant or insignificant or regardless of whether the information formed is visualized so that the human eye can visually perceive it, as well as the manipulation of the printing medium.

A "printing medium" is any medium capable of accepting ink, such as cloth, plastic films, metal plates, glass, ceramics, wood, leather, as well as paper sheets used in an ordinary printing apparatus.

Furthermore, "ink" (also referred to as a "liquid" below) should be broadly interpreted in the manner of the definition of "print" set forth above. That is, ink is a liquid which, by being applied to a printing medium, forms images, figures and patterns, manipulates the printing medium or treats ink (e.g., solidifies or insolubilizes a colorant in ink applied to a printing medium).

<Overview of the apparatus>

Figure 5:
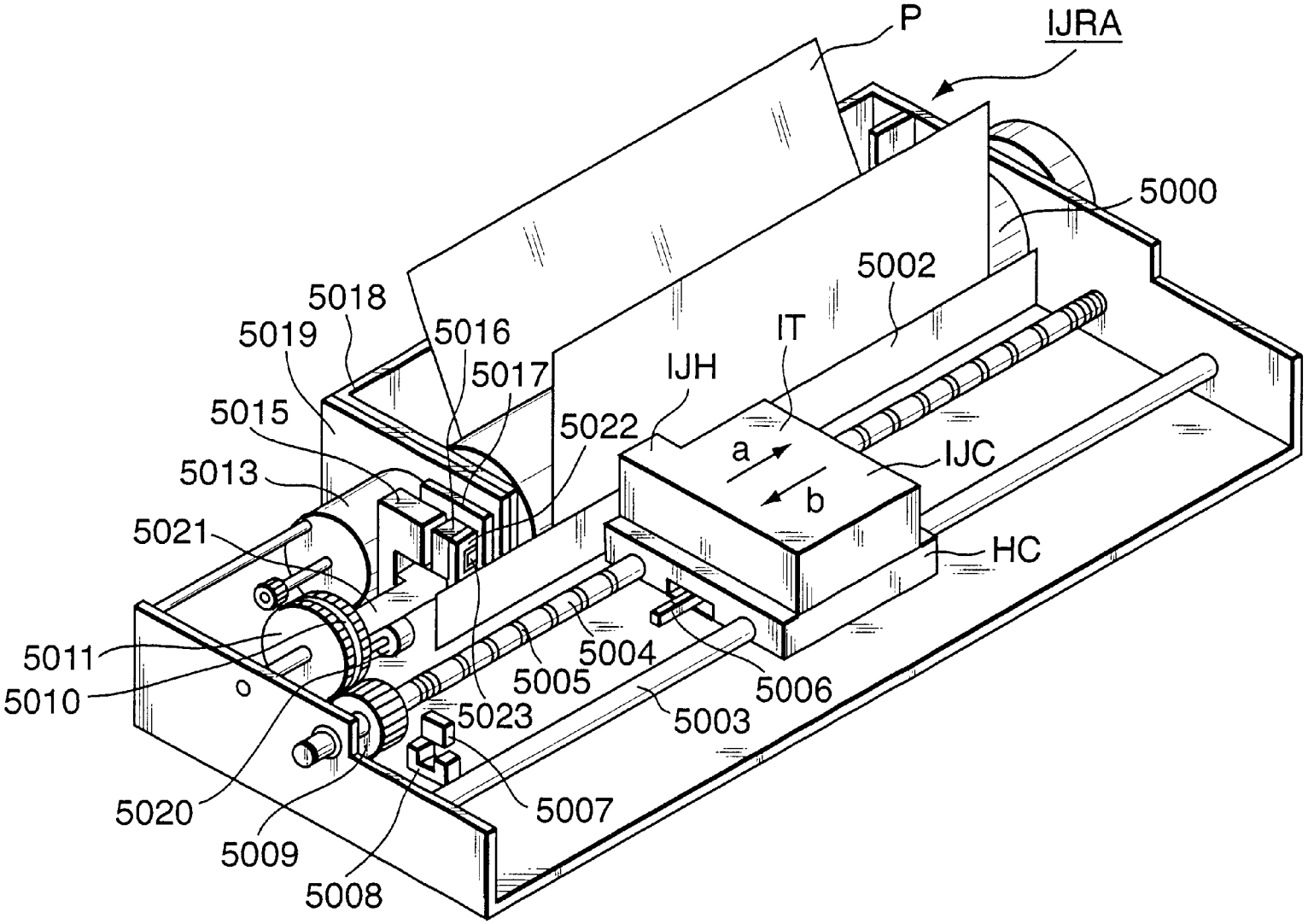
FIG. 5 is a perspective view illustrating the external appearance of a printer according to a preferred embodiment of the present invention.

FIG. 5 is an external perspective view showing the structure of an ink-jet printer IJRA, which is a typical embodiment of the present invention.

As shown in FIG. 5, a carriage HC is engaged with a helical groove 5004 of a lead screw 5005 rotated via driving force transmission gears 5009 to 5011 in operative association with the forward and reverse rotation of a driving motor 5013. The carriage HC, which has a pin (not shown), is supported on a guide rail 5003 and is moved back and forth in directions of arrows a and b. An integrated ink-jet cartridge IJC, which internally accommodates a printhead IJH and an ink tank IT, is mounted on the carriage HC.

Numeral 5002 denotes a paper retaining plate which presses printing paper P against a platen 5000 along the traveling direction of the carriage HC. Numerals 5007, 5008 denote photocouplers which constitute home position sensing means for verifying the presence of a carriage lever 5006 in the vicinity of the photocouplers and changing over the direction in which the motor 5013 is rotated.

Numeral 5016 denotes a member which supports a cap member 5022, which is for capping the front side of the printhead IJH. Numeral 5015 denotes a suction device for applying suction to the cap to subject the printhead to suction recovery via an opening 5023 inside the cap. Numeral 5019 denotes a member which makes it possible to move a cleaning blade 5017 back and forth. The cleaning blade 5017 and the member 5019 are supported on a support plate 5018. It goes without saying that the blade need not be of this type and that a well-known cleaning blade can be applied to this example.

Numeral 5021 denotes a lever for starting the suction of the suction recovery operation. The lever moves with movement of a cam 5020 engaged with the carriage. Movement is controlled by well-known transfer means whereby the driving force from the driver motor is changed over as by a clutch.

The capping, cleaning and suction recovery operations are so arranged that the desired processing is performed at the corresponding positions by the action of the lead screw 5005 when the carriage arrives in an area on the home-position side. However, if it is so arranged that the desired operations are performed at well-known timings, this arrangement can also be applied to this example.

<Description of control structure>

A control structure for controlling printing by the printing apparatus set forth above will now be described.

Figure 6:
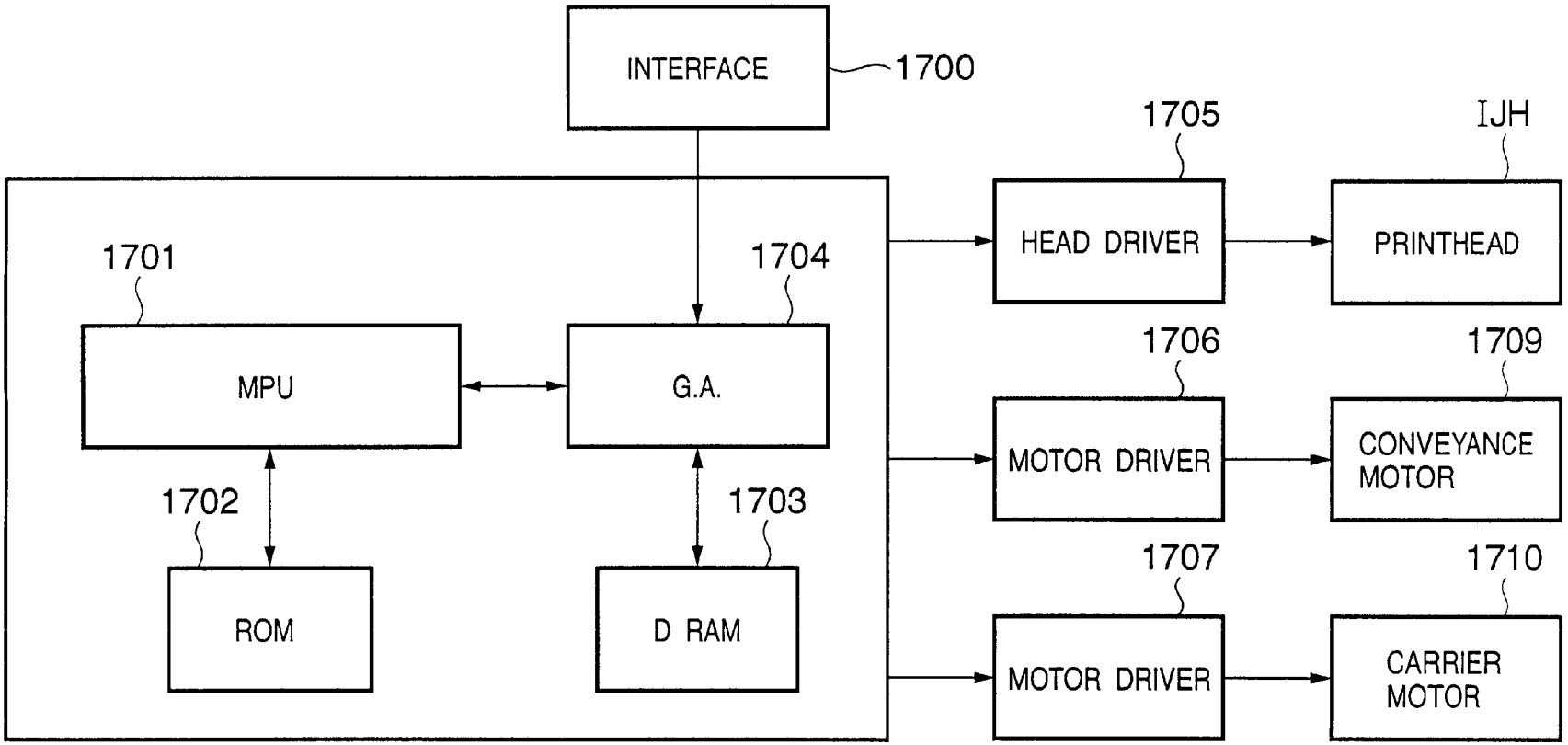
FIG. 6 is a block diagram illustrating the structure of a control circuit of the printer shown in FIG. 5.

FIG. 6 is a block diagram illustrating the structure of a control circuit for controlling the ink-jet printhead IJRA. The control circuit includes an interface 1700 for entering a print signal, an MPU 1701, a ROM 1702 for storing a control program executed by the MPU 1701, a D RAM 1703 in which various data (the above-mentioned print signal as well as print data supplied to the printhead) is saved, and a gate array (GA) 1704 for controlling supply of print data to the printhead IJH and for controlling transfer of data between the MPU 1701 and RAM 1703. A carrier motor 1710 transports the printhead IJH, and a conveyance motor 1709 conveys printing paper. A head driver 1705 drives the printhead IJH, and motor drivers 1706, 1707 drive the conveyance motor 1709 and carrier motor 1710, respectively.

Operation of the control structure is as follows: When a print signal enters the interface 1700, the gate array 1704 and MPU 1701 cooperate to convert the print signal to print data for printing. The motor drivers 1706, 1707 are driven so that the printhead is actuated and performs printing in accordance with the print data sent to the head driver 1705.

Though the control program executed by the MPU 1701 is stored in the ROM 1702, an arrangement may be adopted in which a writable storage medium such as an EEPROM is additionally provided so that the control program can be altered from a host computer connected to the ink-jet printer IJRA.

As mentioned above, the ink tank IT and the printhead IJH may be formed as an integrated body to construct the replaceable ink cartridge IJC. However, the ink tank IT and printhead IJH may be constructed so as to be separable from each other so that only the ink tank IT is replaced when the ink runs out.

Figure 7:
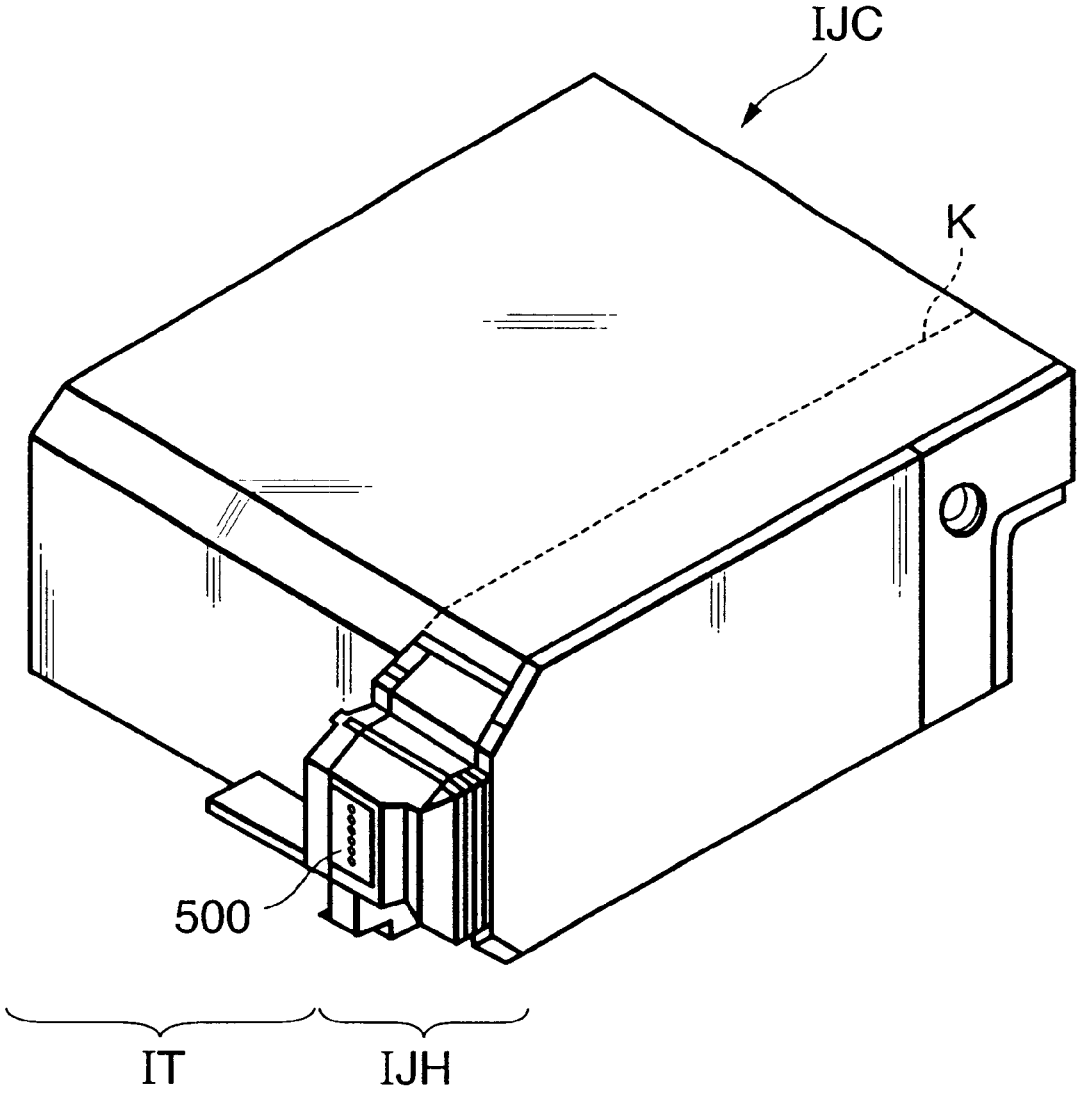
FIG. 7 is a perspective view illustrating an ink-jet cartridge of the printer shown in FIG. 5.

FIG. 7 is an external perspective view showing the structure of the ink cartridge IJC, in which the ink tank and head are separable. As shown in FIG. 7, the ink cartridge IJC is such that the ink tank IT and printhead IJH can be separated from each other at the position of a boundary line K. The ink cartridge IJC is provided with an electrode (not shown) for receiving an electric signal, which is supplied from the side of the carriage HC, when the ink cartridge IJC is mounted on the carriage HC. The printhead IJH is driven by this electric signal, in the manner described above, whereby ink is ejected from the printhead.

As shown in FIG. 7, the printhead IJH has a row of ink orifices 500. Further, the ink tank IT is provided with a fibrous or porous ink absorbing body in order to hold the ink.

<First Embodiment>

A first embodiment of the present invention will now be described with reference to FIG. 1, which illustrates an equivalent circuit on a heater board. The heater board of this embodiment is formed on the semiconductor substrate of silicon. The equivalent circuit shown in FIG. 1 is formed at deposition process of semiconductor manufacturing process.

Figure 1:
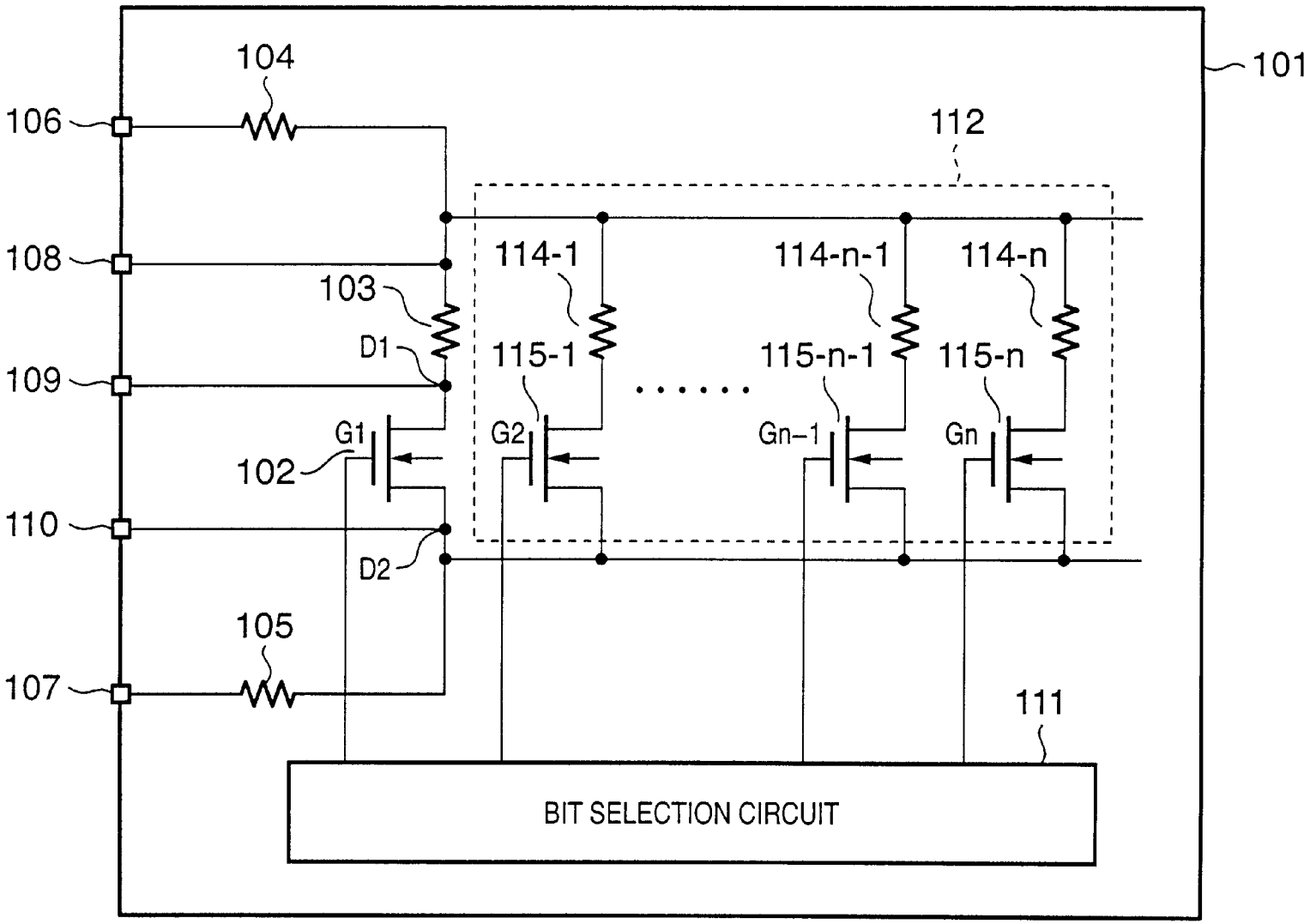
FIG. 1 is a circuit diagram showing the equivalent circuit on a heater board according to a first embodiment.

As shown in FIG. 1, a heater board 101 has heaters and driving circuit elements therefor formed thereon. A driving element 102 supplies current to a corresponding monitor resistor element. Here a MOS transistor exemplifies the driving element 102 for the monitor element. A heater resistor element 103 serves as the corresponding monitor resistor element. The monitor resistor element 103 and heaters for ejecting ink(elements for printing) are formed in the same deposition conditions and the same deposition process. Wires 104, 105 are power-supply wires connected to the monitor resistor element 103 and MOS transistor 102, respectively. The wires 104, 105 include the resistance of wiring leading to contact pads 106, 107 by which the heater board is connected to the outside. Contact pads 108, 109, 110 are monitor terminals for measuring element characteristics. The pad 108 is connected to a node between the monitor resistor element 103 and power-supply wire 104, the pad 109 is connected to a node (D1) between the monitor resistor element 103 and the drain of MOS transistor 102, and the pad 110 is connected to a node (D2) between the drain of MOS transistor 102 and the wire 105.

A bit selection circuit 111 is connected to the gates (Gn) of MOS transistors and drives the gates of the MOS transistors by a drive signal (not shown) from the printer proper in such a manner that desired heaters, for the ejecting ink or the monitor resistor element, are driven in accordance with print data.

A block 112 in FIG. 1 has ejecting heaters (114-1, . . . 114-n-1, 114-n) for actually jetting ink and MOS transistors (115-1, . . . 115-n-1, 115-n) for driving corresponding ones of these heaters.

In a case where ejecting heaters for actually ejecting ink and its MOS transistor are found to be the same deposition conditions, deposition process, and same size as the monitor resistor element for sensing characteristics and its driving element upon measuring the characteristic (here the resistance value) of the printing elements(the heaters for ejecting ink), the same size (identical characteristics) is not required if detection resistance value of the monitor resistance element is highly set up in order to enhance measurement accuracy. If the manufacturing method, deposition conditions, deposition process and structure of the element for monitoring the characteristic are the same as those of the heater that ejects the ink and the relative resistance values of the ink ejecting heater and MOS transistor are maintained, it is possible to raise the absolute value of the resistance value using an element of a different size.

A method of sensing the characteristics of the monitoring driving element 102 and monitor resistor element 103 in FIG. 1 will now be described with reference also to the flowchart of FIG. 8.

Figure 8:
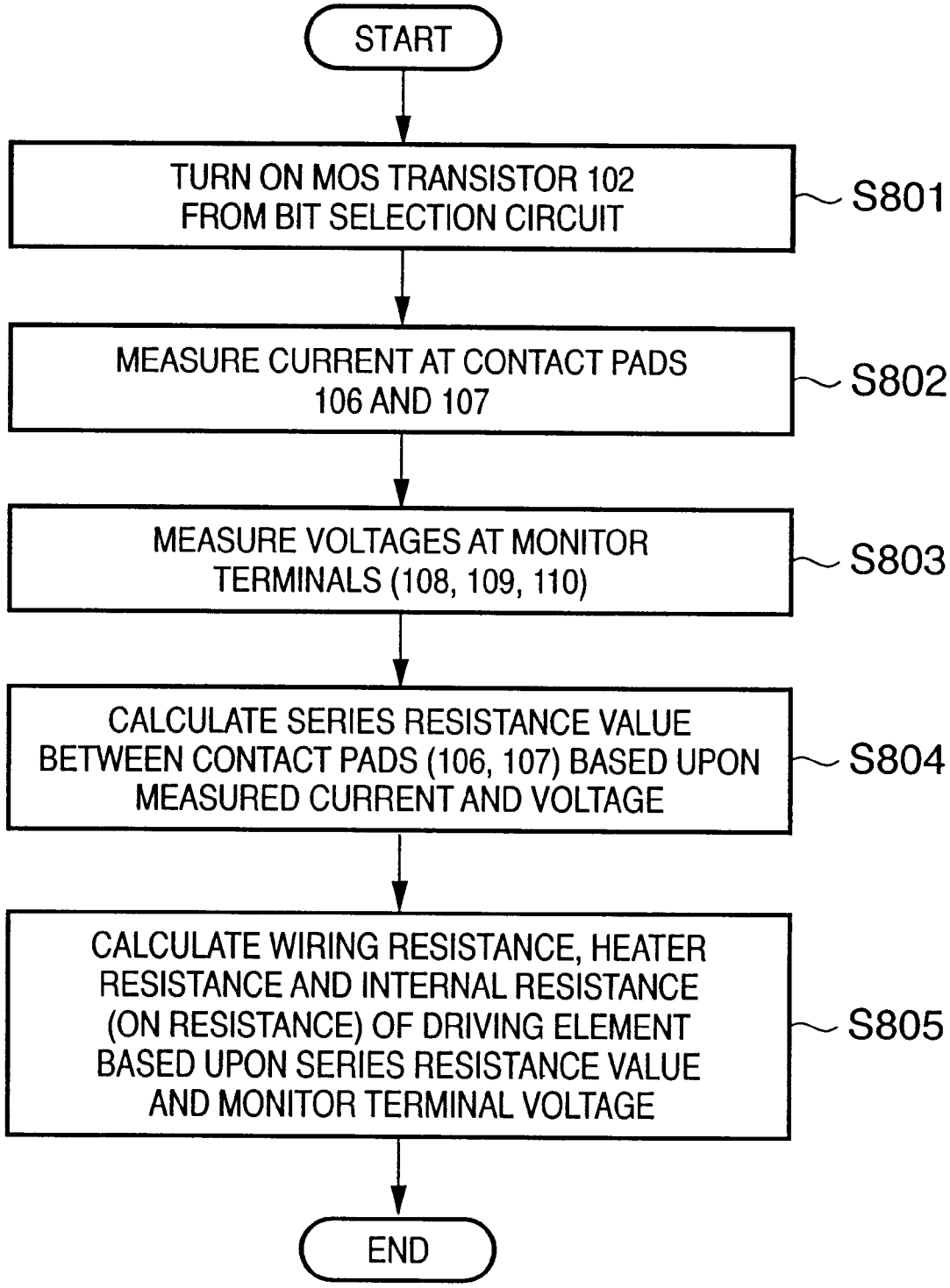
FIG. 8 is a flowchart useful in describing processing for measuring the resistance value of an element connected in series with a heater according to an embodiment of the invention.

In a manner similar to the case where the ejecting heater (114*n*) that ejects ink is driven in FIG. 1, the MOS transistor 102 has its gate driven by the bit selection circuit 111, whereby the MOS transistor 102 is turned on (step S801 in FIG. 8). At this time the other heaters connected to the wires 104, 105 are not being driven.

Since the pads 106 and 107 are connected to the power supply and to ground, respectively, a current flows into the MOS transistor 102, monitor resistor element 103 and power-supply wires 104, 105. At this time the current that flows into the pad 106 or 107 is measured (step S802). The voltages at the monitor terminals 108, 109, 110 are then measured (step S803). From the measured current and voltages, the series resistance value between the pads 106 and 107 is calculated (step S804).

The wiring resistance of the power-supply wires 104, 105, the resistance of the monitor resistor element 103 and the value of the ON resistance of driving element 102 for the monitor resistor element are found from the voltages at the monitor terminals 108, 109, 110 and the series resistance value (step S805). The total of these resistance values obtained is the value of series resistance acting as a combined resistor. The voltage applied to the ejecting heaters to actually eject ink based upon this value can be calculated precisely independently of any variation in the resistance of the wiring or in the ON resistance value of the MOS transistor. This method enables calculation of the voltage value of sufficient accuracy, even if the variation in resistors intervenes. By implementing such element-characteristic sensing means in the printer per se, it is possible to introduce the optimum energy to individual printheads having different element characteristics. That is, the current that flows into the pads 106, 107 and the voltages detected at the monitor terminals 108, 109, 110 are processed by the control circuit (MPU 1701 and gate array 1704) on the side of the printer in FIG. 6, and the resistance values of each of the elements [the power-supply distribution resistances, the monitor resistor element (heater) resistances and the driving element resistances for the monitor resistor element (the ON resistance values of the MOS transistors)] are calculated.

On the basis of these values the printhead IJH is controlled in such a manner that a constant energy will be introduced to the printing elements in order to compensate for variation of each of the elements.

In a case where providing the printer proper with resistance-value sensing means is a cause of higher cost, the above-mentioned element characteristics are sensed in the course of manufacture of the printhead, the energy necessary to be applied to the heater is written to a print holding elements such as an EEPROM mounted on the printhead, and control is performed based upon this information in the printer proper on which the printhead has been mounted. This makes it possible to apply the optimum energy to individual printheads and to lower the cost of the printer proper.

An arrangement can also be adopted in which the characteristics of heaters and MOS transistors are sensed by the above-described conventional technique (Japanese Patent Application Laid-Open No. 10-95116), the pad 109 is eliminated in the circuit of FIG. 1 and only the resistance of power-supply wiring is sensed. Further, since the power-supply wires 104 and 105 are fabricated on the same board, the relative relationship between the resistance values of the power-supply wires 104 and 105 on the same board is substantially constant irrespective of the individual heater board. Accordingly, by adopting an arrangement in which the resistance of power-supply wire 104 or 105 is sensed, the pad 108 or 110 can be eliminated.

<Second Embodiment>

A second embodiment of the present invention will now be described with reference to FIG. 2, which illustrates an equivalent circuit on a heater board.

Figure 2:
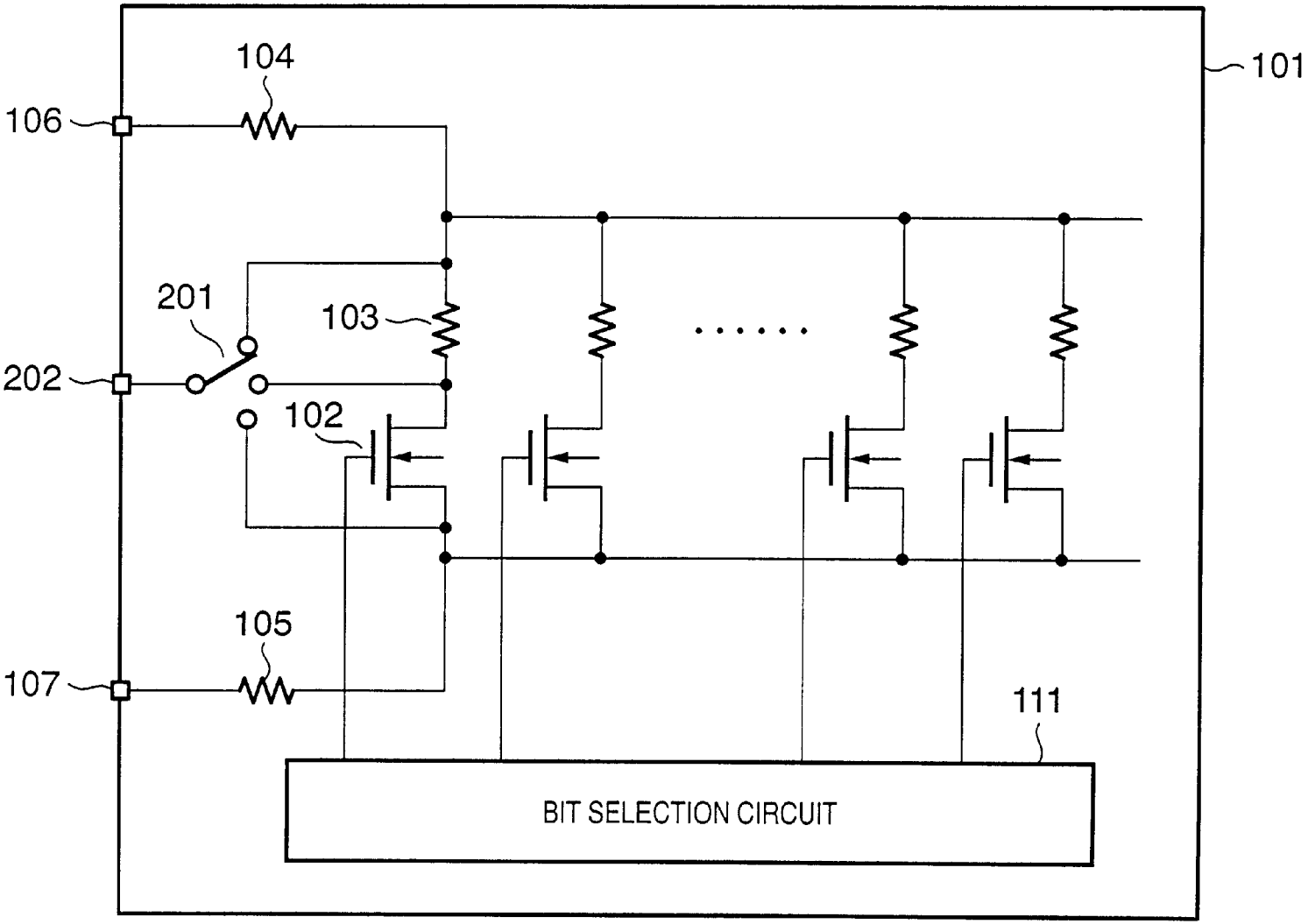
FIG. 2 is a circuit diagram showing the equivalent circuit on a heater board according to a first embodiment.
Figure 3:
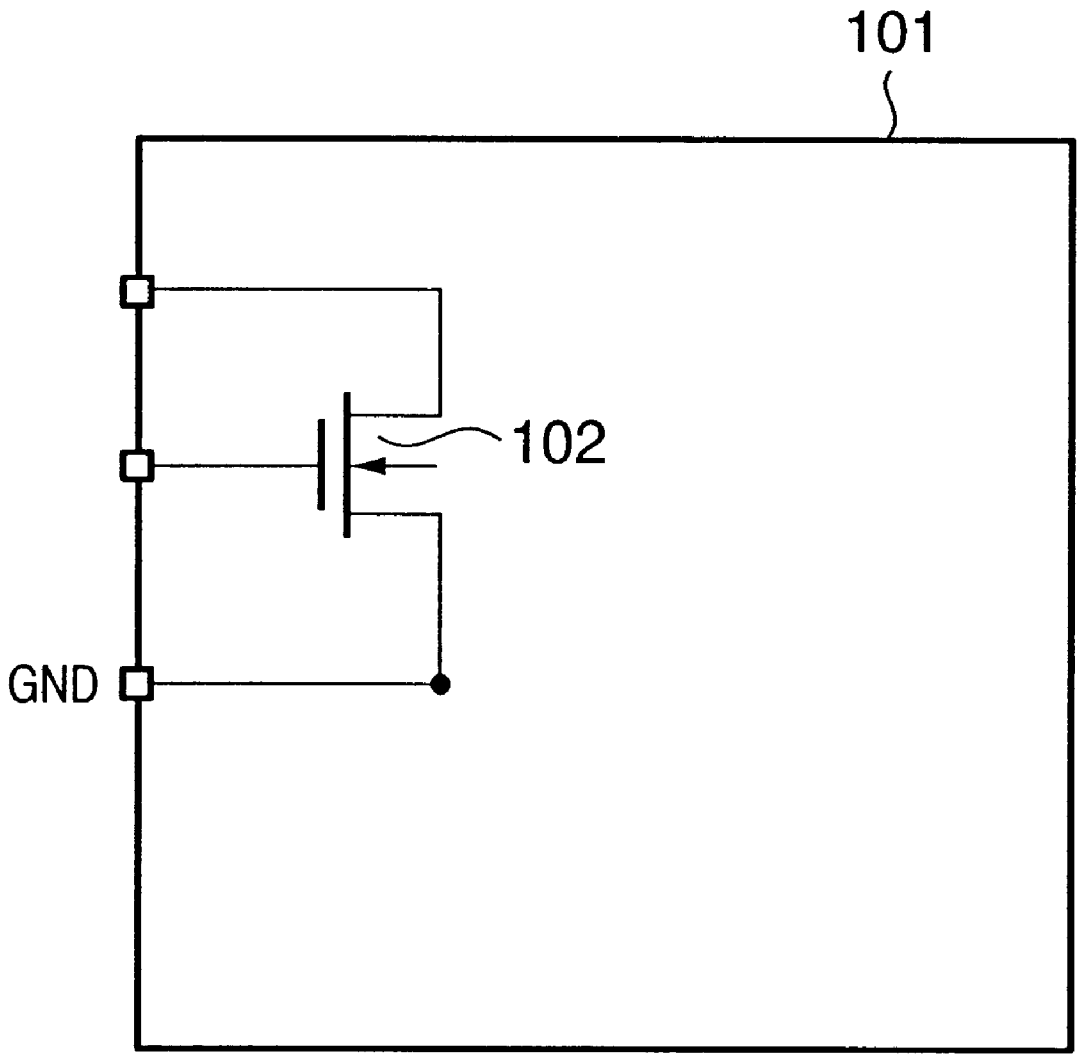
FIG. 3 is a circuit diagram showing a temperature sensing circuit.
Figure 4:
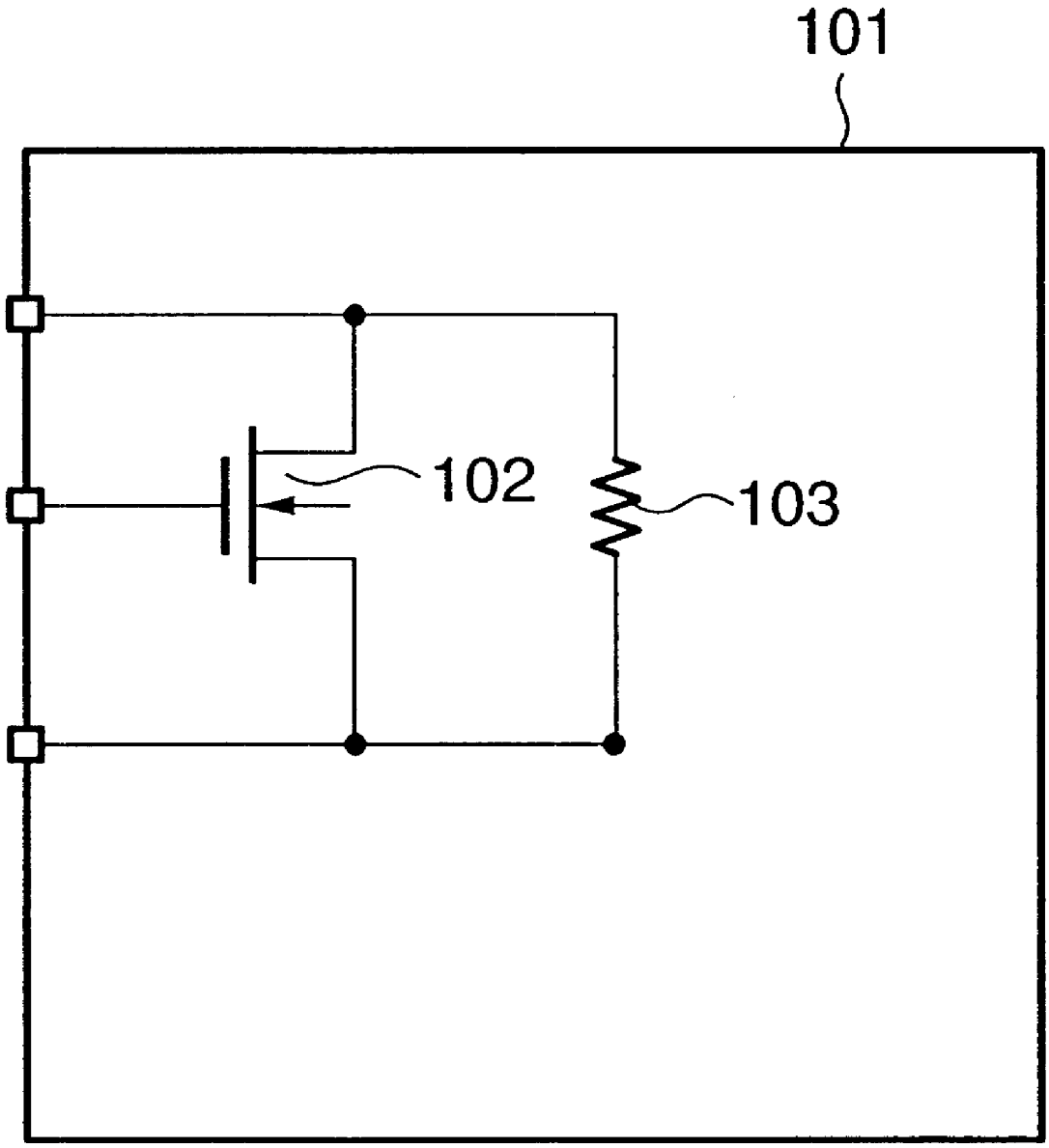
FIG. 4 is a circuit diagram showing another example of a temperature sensing circuit.

As shown in FIG. 2, a selection circuit 201 selects the node between a monitor resistor element and a power-supply wire, the node between a monitor resistor element and a MOS transistor, or the node between the MOS transistor and a power-supply wire in accordance with a control signal (not shown), and delivers an output from the selected node to a contact pad 202. The sensing method in this case is performed in a manner similar to that of the first embodiment, the MOS transistor 102 is driven by the bit selection circuit 111 and the voltage drops of the power-supply wires, monitor resistor element and driving element for the monitor resistor element are measured. The voltage at each point at this time is output to the pad 202 by switching over the selection circuit 201, whereby the characteristic of each individual element can be sensed. The pads 108, 109, 110 serving as the monitor terminals for sensing the characteristics of the elements can be eliminated from the first embodiment.

<Third Embodiment>

Figure 9:
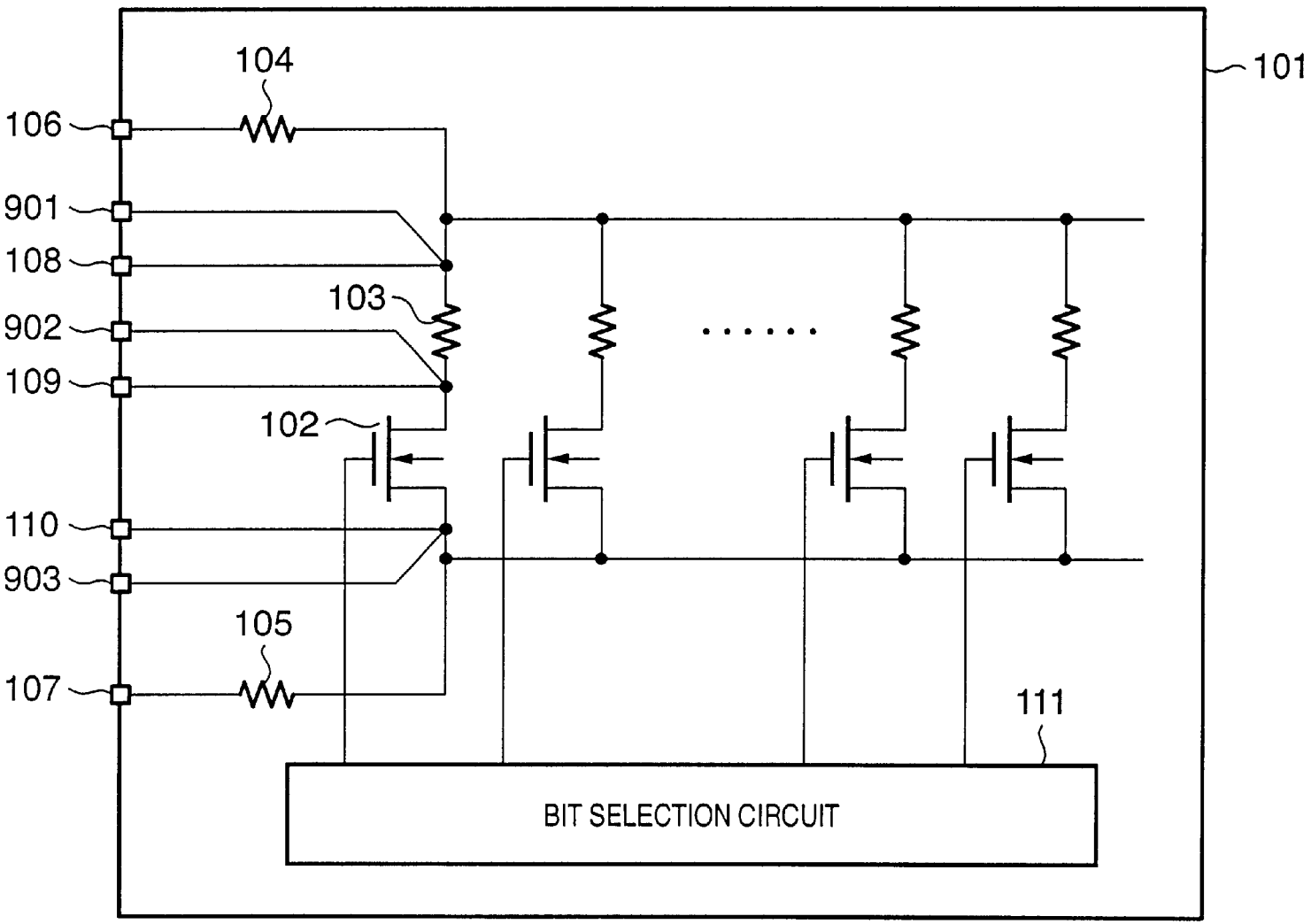
FIG. 9 is a circuit diagram showing the equivalent circuit on a heater board according to a third embodiment.

A third embodiment of the present invention will now be described with reference to FIG. 9, which illustrates an equivalent circuit on a heater board.

Here contact pads 901, 902, 903 are connected respectively to the same nodes as those to which the monitor pads 108, 109, 110 for measuring voltage are connected. Current is applied from any of the contact pads 901, 902, 903 and voltage is sensed from the pads 108, 109, 110, whereby the characteristics of each of the elements are sensed. By separately providing the arrangement of the first embodiment with terminals for applying current and terminals for sensing voltage, it is possible to ignore error such as the voltage drop across wiring to which current is applied. As a result, the characteristics of the individual elements are found with higher precision.

<Fourth Embodiment>

A fourth embodiment of the present invention will now be described with reference to FIG. 10, which illustrates an equivalent circuit on a heater board.

Figure 10:
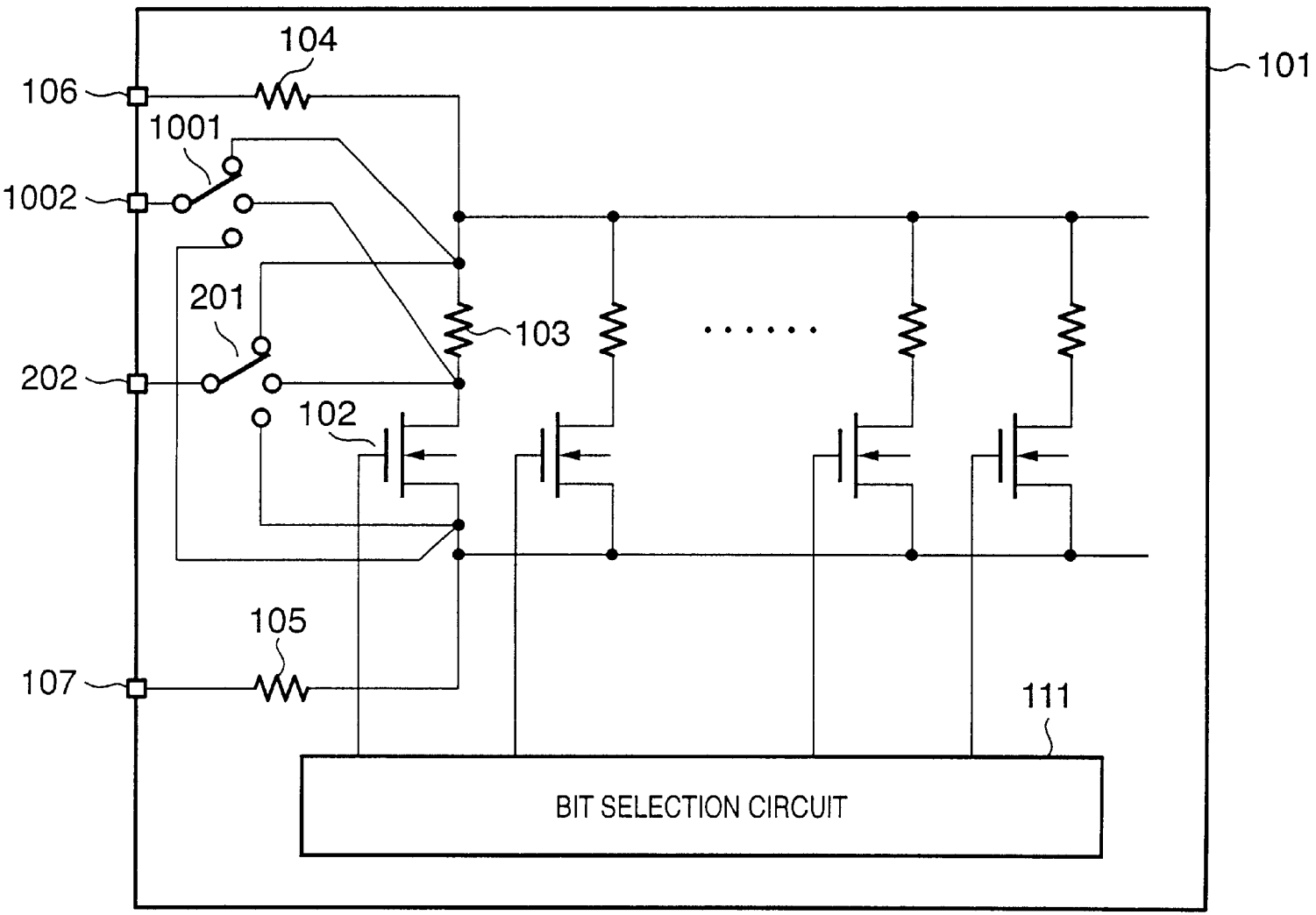
FIG. 10 is a circuit diagram showing the equivalent circuit on a heater board according to a fourth embodiment.

As shown in FIG. 10, the selection circuit 201 selects the node between a monitor resistor element and a power-supply wire, the node between the monitor resistor element and a MOS transistor, or the node between the MOS transistor and a power-supply wire in accordance with a control signal (not shown), and delivers an output from the selected node to the contact pad 202. Similarly, a selection circuit 1001 selects the node between a monitor resistor element and a power-supply wire, the node between the monitor resistor element and the MOS transistor, or the node between the MOS transistor and a power-supply wire in accordance with a control signal (not shown), and applies current from the pad 1002 to the selected node.

The sensing method in this case is performed in a manner similar to that of the third embodiment and sensed voltage is output to the pad 202 by successively switching over the selection circuit 201, whereby the characteristics of the individual elements can be sensed. The pads 108, 109, 110 serving as the monitor terminals for sensing the characteristics of the elements and the pads 901, 902, 903 can be eliminated from the first embodiment.

In addition, in the above embodiment, though the monitor resistance element is explained as an element which is not used for printing, it may be also possible to perform monitoring by using the element used for printing.

In the foregoing embodiments, it is assumed that the liquid ejected from the printhead driven by printing elements is ink, and that the liquid contained in the ink tank is ink. However, the content of the tank is not limited to ink. For example, in order to improve the fixation or water resistance of a printed image and raise the quality of the image, a substance such as a treating solution ejected toward the printing medium may be accommodated in the ink tank.

The foregoing embodiments are described in regard to a printing apparatus, particularly of the ink-jet printing type, equipped with means (e.g., an electrothermal transducer or laser beam generator) for generating thermal energy as the energy utilized to discharge ink, wherein a change in the state of the ink is brought about by this thermal energy, thereby making it possible to achieve high-density, high-definition printing.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. Particularly, in the case of the on-demand type, at least one drive signal, which provides a sudden temperature rise that exceeds that for film boiling, is applied, in accordance with printing information, to an electrothermal transducer arranged to correspond to a sheet or liquid passageway holding a liquid (ink). As a result, thermal energy is produced in the electrothermal transducer to bring about film boiling on the thermal working surface of the printhead. Accordingly, air bubbles can be formed in the liquid (ink) in one-to-one correspondence with the drive signal.

Owing to growth and contraction of the air bubbles, the liquid (ink) is ejected through an orifice so as to form at least one droplet. If the drive signal has the form of a pulse, growth and contraction of the air bubbles can be made to take place rapidly and in appropriate fashion. This is preferred since it will be possible to achieve liquid (ink) ejection exhibiting excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention relating to the rate of increase in the temperature of the above-mentioned thermal working surface.

In addition to the combination of the orifices, fluid passageways and electrothermal transducers (in which the fluid passageway is linear or right-angled) disclosed as the construction of the printhead in each of the above-mentioned specifications, an arrangement using the art described in the specifications of U.S. Pat. Nos. 4,558,333 and 4,459,600, which disclose elements disposed in an area in which the thermal working portion is curved, may be employed.

As a printhead of the full-line type having a length corresponding to the maximum width of the printing medium capable of being printed on by the printing apparatus, use can be made of an arrangement in which the length is satisfied by a combination of multiple printheads of the kind disclosed in the foregoing specifications, or an arrangement in which printheads serve as a single integrally formed printhead.

The printhead may be of the replaceable tip-type, in which the electrical connection to the apparatus proper and the supply of ink from the apparatus proper can be achieved by mounting the head on the apparatus proper, or of the cartridge type, in which the printhead itself is integrally provided with an ink tank.

In order to make the effects of printing much more stable, it is preferred that the printing apparatus described above be additionally provided with printhead recovery means and auxiliary means, etc. Specific examples are printhead capping means, cleaning means, pressurizing or suction means, preheating means comprising an electrothermal transducer, a heating element separate from this transducer or a combination of the transducer and the heating element, and a pre-ejection mode for performing ejection of ink independently of printing. These expedients are effective in achieving stable printing.

Furthermore, the printing mode of the printing apparatus is not limited to one in which printing is performed using only a mainstream color such as black. The apparatus can be one which has at least a multiple-color mode in which printing is performed using multiple colors or a full-color mode in which printing is performed using mixed colors. This may be achieved by using an integrated printhead or by combining a plurality of printheads.

A printing apparatus according to the present invention may take on a variety of forms. It may be provided as an integral part of or separate from an information processing device such as a computer and serve as the image output terminal thereof, as a copier apparatus in combination with a reader or the like, or as a facsimile machine having sending and receiving functions.

<Other Embodiments>

The present invention can be applied to a system constituted by a plurality of devices (e.g., a host computer, interface, reader, printer, etc.) or to an apparatus comprising a single device (e.g., a copier or facsimile machine, etc.).

Thus, in accordance with the present invention, as described above, resistance values of a driving element and wiring resistance serially connected to a printing element can be measured accurately and a constant energy can be applied to the printing element at all times despite a variation in the resistance of each of the elements. This makes it possible to perform printing that is of high definition, high quality and high reliability.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus for performing printing by using a printhead on a printing medium, based upon information transmitted from an external device, said printhead comprising:

selection means for selecting one driving element to be driven;

a first wiring structure in which the driving element and a monitor resistor element are serially connected;

a second wiring structure in which the monitor resistor element and a first power-supply wire are serially connected;

a third wiring structure in which the driving element and a second power-supply wire are serially connected; and detecting means for detecting at least one voltage among voltages at a node between the first power-supply wire and the monitor resistor element, a node between the monitor resistor and the driving element, and a node between the driving element and the second power-supply wire, wherein at least one resistance is obtained, based upon the detected voltage, from among resistance of the first and second power-supply wires, resistance of the monitor resistor element and resistance of the driving element, and said printhead is controlled based upon the resistance obtained.

2. The apparatus according to claim 1, wherein said detecting means includes switching means for switching among voltages to be detected, and wherein said switching means switches among detection of voltages at the node between the first power-supply wire and the monitor resistor element, or the node between the monitor resistor element and the driving element, or the node between the driving element and the second power-supply wire, in accordance with a detection control signal.

3. The apparatus according to claim 1, wherein said printhead is an ink-jet printhead for printing by ejecting ink.

4. The apparatus according to claim 1, wherein said printhead is an ink-jet printhead for printing by utilizing thermal energy, said printhead having a thermal energy transducer, which is for generating thermal energy applied to the ink, as the printing element of said printhead.

5. The apparatus according to claim 1, the first power-supply wire and the second power-supply wire can be used as power-supply wires for driving the printing element.

6. A method of controlling printing of a printing apparatus for performing printing by using a printhead on a printing medium, based upon information transmitted from an external device, said method comprising:

a selection step of selecting one driving element to be driven;

a detection step of detecting, in a first wiring structure in which the driving element and a monitor resistor element are serially connected, a second wiring structure in which the monitor resistor element and a first power-supply wire are serially connected, and a third wiring structure in which the driving element and a second power-supply wire are serially connected, at least one voltage among voltages at a node between the first power-supply wire and the monitor resistor element, a node between the monitor resistor element and the driving element, and a node between the driving element and the second power-supply wire; and a control step of obtaining at least one resistance, based upon the detected voltage, from among resistance of the first and second power-supply wires, resistance of the monitor resistor element and resistance of the driving element, and said printhead is controlled based upon the resistance obtained.

7. The method according to claim 6, wherein said detecting step includes a switching step of switching among voltages to be detected, and wherein said switching step includes switching among detection of voltages at the node between the first power-supply wire and the monitor resistor element, or the node between the monitor resistor element and the driving element, or the node between the driving element and the second power-supply wire, in accordance with a detection control signal.

8. The method according to claim 6, the first power-supply wire and the second power-supply wire can be used as power-supply wires for driving the printing element.

9. A printing apparatus for performing printing by using a printhead on a printing medium, based upon information transmitted from an external device, wherein said printhead comprises:

any one of voltage detecting means for detecting at least one voltage among voltages at a node between a first power-supply wire and a monitor resistor element, a node between the monitor resistor element and a driving element, and a node between the driving element and a second power-supply wire; and any one of current application means for applying current to at least one of said nodes, wherein at least one resistance is obtained, based upon applied current or detected voltage, from among resistance of the first and second power-supply wires, resistance of the monitor resistor element and resistance of the driving element, and said printhead is controlled based upon the resistance obtained.

10. The apparatus according to claim 9, wherein said voltage detecting means includes switching means for switching among voltages to be detected, and wherein said switching means switches among detection of voltages at the node between the first power-supply wire and the monitor resistor element, or the node between the monitor resistor element and the driving element, or the node between the driving element and the second power-supply wire, in accordance with a detection control signal.

11. The apparatus according to claim 9, wherein said current application means includes current switching means for switching over application of current, and wherein said current switching means switches between detection of voltages at and application of current to the node between the first power-supply wire and the monitor resistor element, or the node between the monitor resistor element and the driving element, or the node between the driving element and the second power-supply wire, in accordance with a control signal.

12. The apparatus according to claim 9, the first power-supply wire and the second power-supply wire can be used as power-supply wires for driving the printing element.

* * * * *

UNITED STATES PATENT AND TRADEMARK OFFICE

CERTIFICATE OF CORRECTION

PATENT NO. : 6,582,045 B2
DATED : June 24, 2003
INVENTOR(S) : Nobuyuki Hirayama

It is certified that error appears in the above-identified patent and that said Letters Patent is hereby corrected as shown below:

Column 6,
Lines 31-33, should be deleted.

Column 10,
Line 47, “error” should read -- errors --.

Column 13,
Line 35, “claim 1,” should read -- claim 1, wherein --.

Column 14,
Line 14, “claim 6,” should read -- claim 6, wherein --; and
Line 55, “claim 9,” should read -- claim 9, wherein --.

Signed and Sealed this

Sixteenth Day of March, 2004

JON W. DUDAS
*Acting Director of the United States Patent and Trademark Office*